US011279594B2

(12) United States Patent
Yu

(10) Patent No.: US 11,279,594 B2
(45) Date of Patent: Mar. 22, 2022

(54) SOUND ABSORBING PANELS FOR ELEVATOR

(71) Applicant: OTIS ELEVATOR COMPANY, Farmington, CT (US)

(72) Inventor: Zheng Yu, Unionville, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 201 days.

(21) Appl. No.: 16/684,148

(22) Filed: Nov. 14, 2019

(65) Prior Publication Data

US 2021/0147185 A1 May 20, 2021

(51) Int. Cl.
*B66B 11/02* (2006.01)

(52) U.S. Cl.
CPC ..... *B66B 11/024* (2013.01)

(58) Field of Classification Search
CPC ..... B66B 11/024; B66B 11/0226
See application file for complete search history.

(56) References Cited

U.S. PATENT DOCUMENTS 1,872,007 A * 8/1932 Reilly ..... B66B 11/024 454/68
2,265,623 A * 12/1941 Bonsall ..... B61D 27/0081 454/88
2,350,389 A * 6/1944 Coulton ..... B66B 11/024 454/68
2,532,268 A * 11/1950 Christmann ..... B66B 11/024 62/259.1
4,287,962 A * 9/1981 Ingard ..... F01N 1/003 181/224
5,080,003 A * 1/1992 Kappeler ..... B66B 11/024 454/68
5,306,208 A * 4/1994 Sommerrock ..... B66B 11/024 454/68
5,354,233 A * 10/1994 Mandy ..... B66B 11/024 187/393
5,454,449 A * 10/1995 Makimattila ..... B66B 11/0226 187/401
5,460,570 A * 10/1995 Okamura ..... B66B 11/024 454/68

(Continued)

FOREIGN PATENT DOCUMENTS

CN 208994915 6/2019
JP S5049158 5/1975

(Continued)

OTHER PUBLICATIONS

Extended EP Search Report for EP Application 20206808.6 dated Apr. 7, 2021.

*Primary Examiner* — Michael A Riegelman
(74) *Attorney, Agent, or Firm* — Carlson, Gaskey & Olds, P.C.

(57) ABSTRACT

A panel assembly for an elevator cab includes an outer panel that defines an exterior surface of the elevator cab. A first inner panel is spaced from the outer panel and at least partially defines a first cavity with the outer panel. A foam panel is located adjacent one of the outer panel and the first inner panel. A first passage opening is associated with the first panel and is in fluid communication with a ventilation passage at least partially defined by one of the inner panel or the outer panel.

12 Claims, 6 Drawing Sheets

(56) References Cited

U.S. PATENT DOCUMENTS

| | | | | |
|---|---|---|---|---|
| 5,593,347 | A * | 1/1997 | Mandy | B66B 11/024 187/393 |
| 7,833,310 | B2 * | 11/2010 | Kwon | B03C 3/383 95/3 |
| 8,336,672 | B2 * | 12/2012 | Derks | F24F 13/24 181/224 |
| 8,500,525 | B2 * | 8/2013 | Opoku | B66B 11/024 454/68 |
| 9,248,996 | B2 * | 2/2016 | Wuest | B66B 11/024 |
| 10,800,638 | B2 * | 10/2020 | Bonatre | B66B 11/024 |
| 2005/0124282 | A1 * | 6/2005 | Santos | B66B 11/024 454/68 |
| 2005/0161280 | A1 * | 7/2005 | Furuya | F01N 1/003 181/225 |
| 2008/0190711 | A1 * | 8/2008 | Patrick | B66B 11/024 187/401 |
| 2010/0126810 | A1 * | 5/2010 | Opoku | B66B 11/024 187/401 |
| 2014/0305749 | A1 * | 10/2014 | Manner | B66B 11/024 187/401 |
| 2015/0056905 | A1 * | 2/2015 | Baek | B66B 11/024 454/68 |
| 2017/0001838 | A1 * | 1/2017 | Polak | B66B 13/30 |
| 2019/0056127 | A1 * | 2/2019 | Piech | F24F 11/79 |
| 2021/0147185 | A1 * | 5/2021 | Yu | B66B 11/024 |

FOREIGN PATENT DOCUMENTS

| | | |
|---|---|---|
| JP | 2000103581 | 4/2000 |
| WO | 2006011885 | 2/2006 |

* cited by examiner

SOUND ABSORBING PANELS FOR ELEVATOR

TECHNICAL FIELD

This disclosure relates to an improvement noise reduction in an elevator cab of an elevator system through the use of sound absorbing panels.

BACKGROUND

An elevator cab includes a passenger compartment that is typically defined by a floor, a ceiling, a pair of side walls, a front wall, and a back wall. The elevator cab moves vertically in a hoistway through the use of elevator machinery utilizing various cables, weights, and motors. The motion of the elevator cab and as well the elevator machinery can generate noise inside the passenger compartment. Therefore, there is a need to reduce noise inside a passenger compartment of the elevator cab to improve passenger comfort.

SUMMARY

In one exemplary embodiment, a panel assembly for an elevator cab includes an outer panel that defines an exterior surface of the elevator cab. A first inner panel is spaced from the outer panel and at least partially defines a first cavity with the outer panel. A foam panel is located adjacent one of the outer panel and the first inner panel. A first passage opening is associated with the first panel and is in fluid communication with a ventilation passage at least partially defined by one of the inner panel or the outer panel.

In a further embodiment of any of the above, the outer panel defines a ceiling of the elevator cab.

In a further embodiment of any of the above, a second inner panel at least partially defines the ventilation passage with the first inner panel.

In a further embodiment of any of the above, at least one of the first inner panel and the second inner panel is perforated.

In a further embodiment of any of the above, the at least one of the first inner panel and the second inner panel that is perforated includes a perforation ratio of less than 50% and more than 0.01%.

In a further embodiment of any of the above, the first inner panel and the second inner panel are both perforated panels.

In a further embodiment of any of the above, a first pair of end walls at least partially define the first cavity with the outer panel.

In a further embodiment of any of the above, a second pair of end walls at least partially define the ventilation passage with the first pair of end walls.

In a further embodiment of any of the above, a second passage opening is in fluid communication with the passage opening and a fan located adjacent one of the first passage opening and the second passage opening.

In a further embodiment of any of the above, the outer panel defines a wall of the elevator cab.

In a further embodiment of any of the above, the ventilation passage is at least partially defined by the foam panel and one of the inner panel or the outer panel.

In a further embodiment of any of the above, at least one of the outer panel and the first inner panel is perforated.

In a further embodiment of any of the above, an exterior opening to the ventilation passage is located adjacent a ceiling of the elevator cab. An interior opening to the ventilation passage is located adjacent a floor of the elevator cab.

In a further embodiment of any of the above, a second inner panel is spaced inward from the first inner panel.

In a further embodiment of any of the above, the ventilation passage is defined by the first inner panel and the second inner panel. The first inner panel and the second inner panel are both perforated.

In a further embodiment of any of the above, the ventilation passage is defined by the outer panel and the first inner panel. The outer panel and the first inner panel are both perforated.

In another exemplary embodiment, a method of reducing noise in an elevator cab includes the step of positioning an outer panel relative to a first inner panel. One of the outer panel and the inner panel are perforated. A fluid is directed through a ventilation passage at least partially defined by one of the outer panel or the inner panel and into a passenger compartment of the elevator cab.

In a further embodiment of any of the above, a foam panel is positioned in abutting contact with at least one of the outer panel or the first inner panel.

In a further embodiment of any of the above, a second inner panel is positioned so it is spaced from the first inner panel to at least partially define a cavity.

In a further embodiment of any of the above, the foam panel is positioned in abutting contact with the first inner panel. The ventilation passage is at least partially defined by the first inner panel.

DETAILED DESCRIPTION

This disclosure relates to improved noise reduction in a passenger compartment of an elevator cab. An example assembly includes a combination a panels with or without perforations, foam located adjacent the panels, and a ventilation passage at least partially defined by the panels. Further, fluid is configured to flow through the ventilation passage. Among other benefits, which will be appreciated from the below description, this disclosure provides a reduction in noise for passengers in an elevator cab as well as ventilation for the elevator cab.

Figure 1:
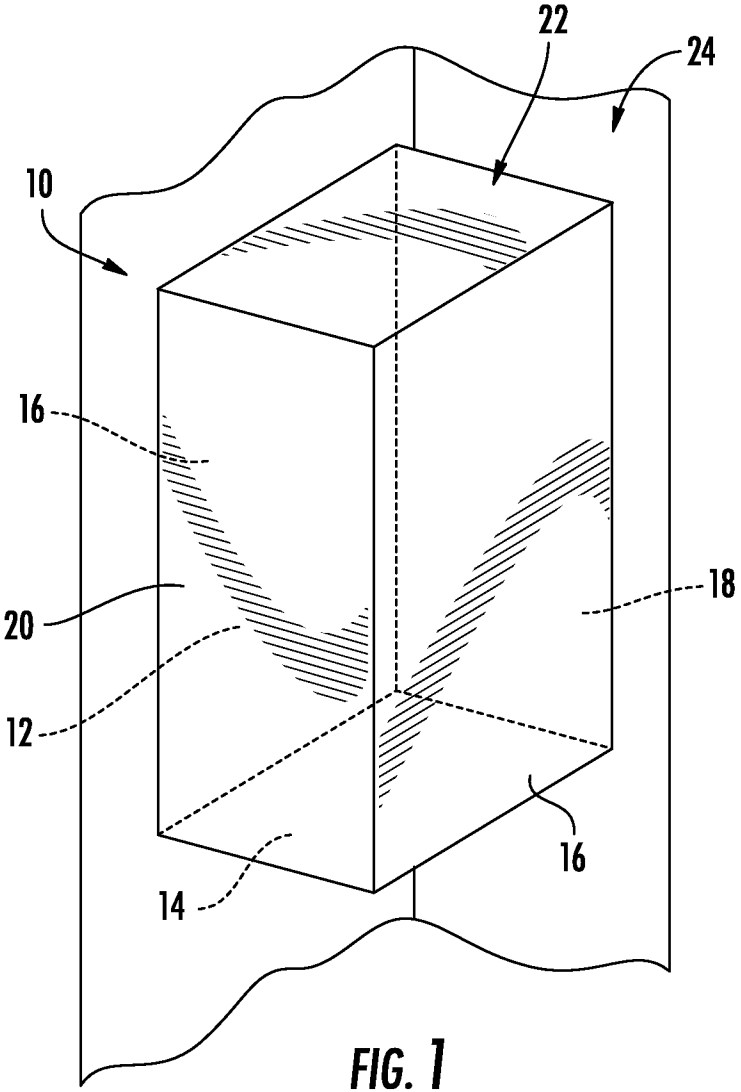
FIG. 1 illustrates a perspective view of an embodiment of an elevator cab in a hoistway.

FIG. 1 illustrates a perspective view of an elevator cab 10. The elevator cab 10 includes a passenger compartment 12 defined by a floor 14, a pair of sidewalls 16, a back wall 18, a front wall 20, and a ceiling 22. An elevator machine (not shown) is used to move the elevator cab 10 within an elevator hoistway 24.

Figure 2:
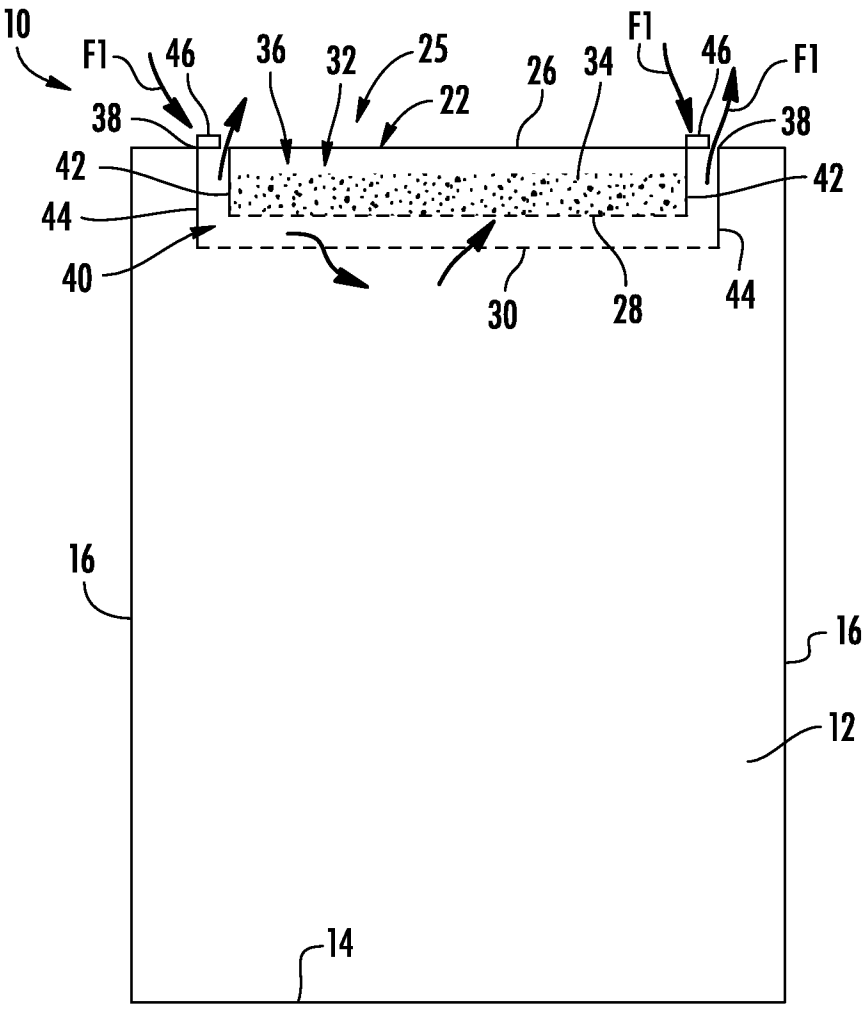
FIG. 2 schematically illustrates a side view of the elevator cab of FIG. 1 showing an embodiment of a ceiling panel assembly.
Figure 3:
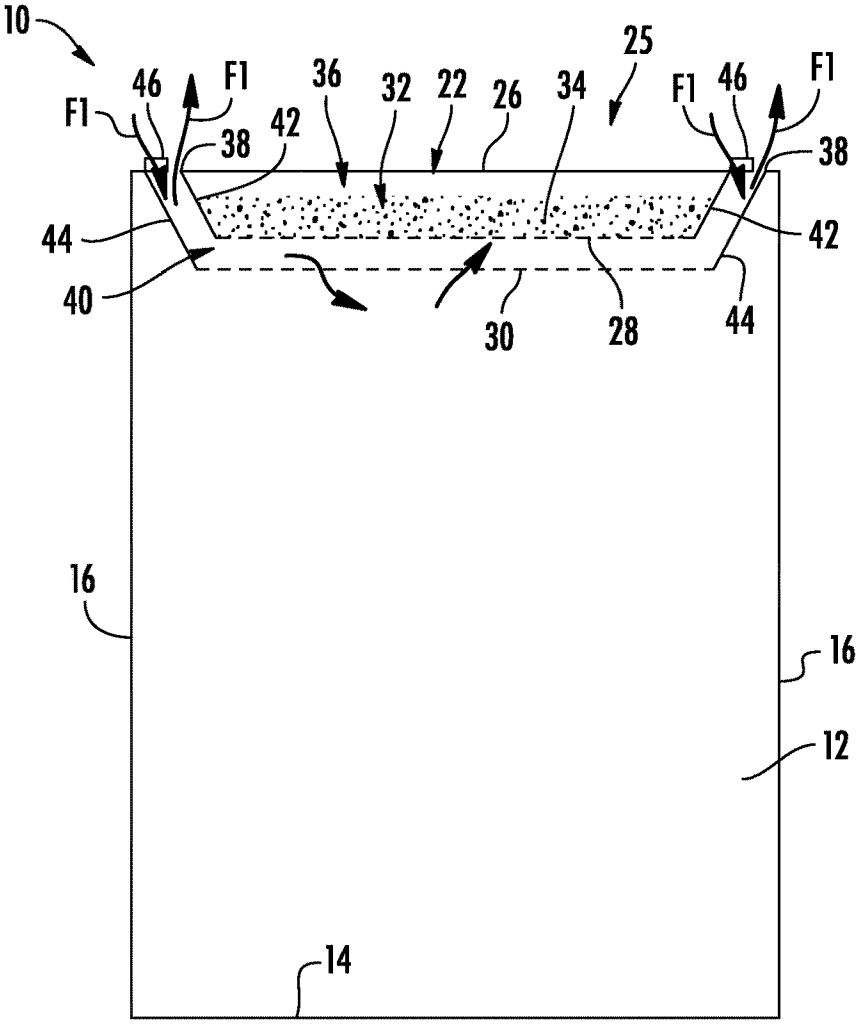
FIG. 3 schematically illustrates a side view of the elevator cab of FIG. 1 showing another embodiment of a ceiling panel assembly.

As shown in FIGS. 2 and 3, the ceiling 22 includes a panel assembly 25 having an outer panel 26, a first inner panel 28, and a second inner panel 30. In the illustrated embodiment, the first and second inner panels 28, 30 are perforated panels having a plurality of openings to allow fluid, such as air to flow through the panels 28, 30. The first inner panel 28 forms an internal cavity 32 with the outer panel 26 and a first pair of ends walls 42. Alternatively, the first pair of end walls 42 could be integral with the first inner panel 28. A foam panel 34 is located in the internal cavity 32 and is in abutting contact with the first inner panel 28. The foam panel 34 also at least partially defines an air gap 36 between the foam panel 34 and the outer panel 26 of the ceiling 22. The foam panel 34 can either be glued with the first inner panel 28 or be placed in abutting contact with the first inner panel 28 without glue.

A ventilation passage 40 is in fluid communication with exterior openings 38 in the outer panel 26 to allow a fluid F1, such as air from within the hoistway 24, to move into and out of the ventilation passage 40. A first boundary of the ventilation passage 40 is formed by the first pair of end walls 42 and the first inner panel 28 and a second boundary of the ventilation passage 40 is formed by a second pair of end walls 44 and the second inner panel 30. Alternatively, the second pair of ends walls 44 could be integral with the second inner panel 30. The fluid F1 can also be drawn into or out of the passenger compartment 12 through perforations in the second inner panel 30 by the use of fans 46 located adjacent each of the exterior openings 38 in the outer panel 26. The fluid F1 is also able to leave the passenger compartment 12 through the exterior openings 38.

In the illustrated embodiment shown in FIG. 2, the ventilation passage 40 defined by adjacent pairs of the first and second pairs of end walls 42, 44 extends in a direction generally perpendicular to the outer panel 26. However, as shown in FIG. 3, the ventilation passage 40 defined by the first and second pairs of end walls 42, 44 could be transverse to the outer panel 26 and not perpendicular as shown in FIG. 2. One feature of either of these arrangements is the ability to further reduce noises from reaching the passenger compartment 12 by changing the direction of the ventilation passage 34 relative to the outer panel 26 to impede certain frequencies depending on operating conditions. Additionally, this arrangement locates the exterior openings 38 in the outer panel 26 to the edges of the ceiling 22, which reduces their visibility.

Figure 4:
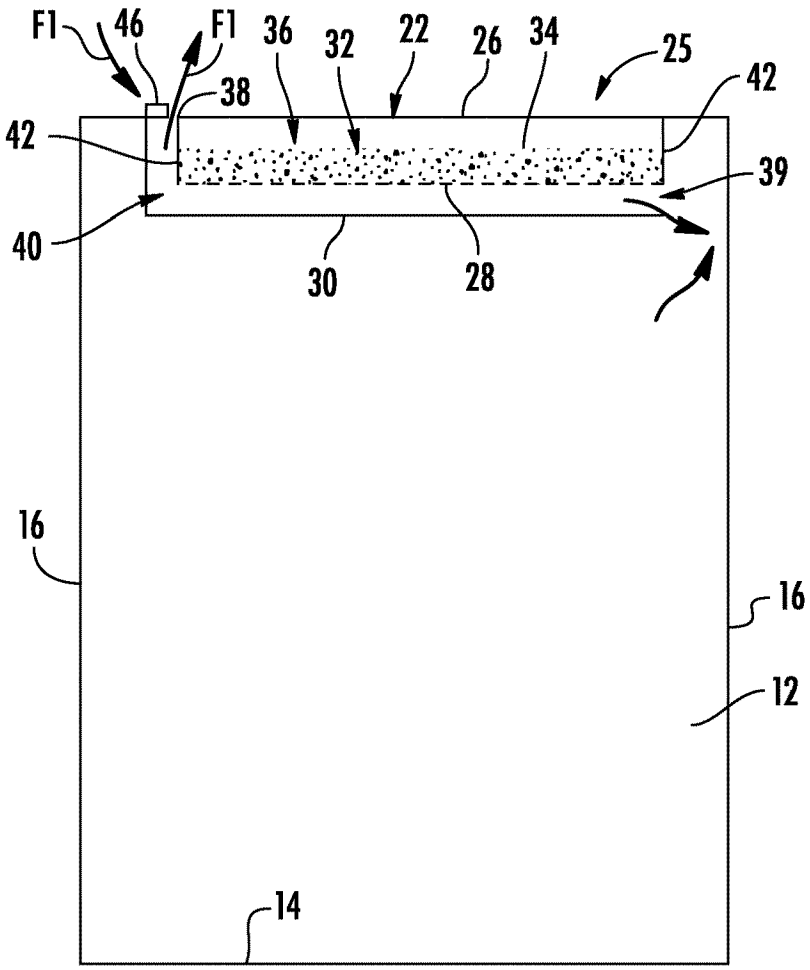
FIG. 4 schematically illustrates a side view of the elevator cab of FIG. 1 showing yet another embodiment of a ceiling panel assembly.

Furthermore, only a single exterior opening 38 in the outer panel 26 could be used to connect the ventilation passage 40 with a single interior opening 39 into the passenger compartment 12 as shown in FIG. 4. Additionally, one of the second pair of end walls 44 could be eliminated when the ventilation passage 40 utilizes the single exterior opening 38 and the single interior opening 39. In the illustrated embodiment, the interior opening 39 is located adjacent an edge of the second inner panel 30 and at least one of the first pair of end walls 42 or the first inner panel 28. The second inner panel 30 could also be a solid panel without perforations and the fluid F1 entering and exiting the passenger compartment 12 would do so through the single exterior opening 38 in the ceiling 22.

Figure 6:
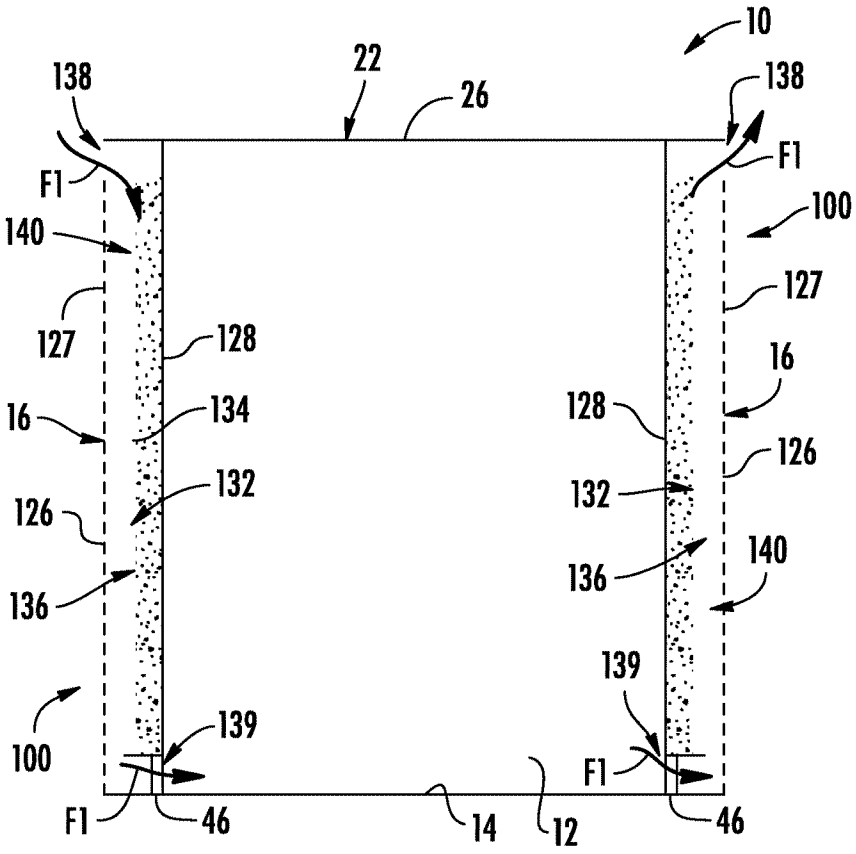
FIG. 6 schematically illustrates a side view of the elevator cab of FIG. 1 showing another embodiment of a double walled panel assembly.
Figure 5:
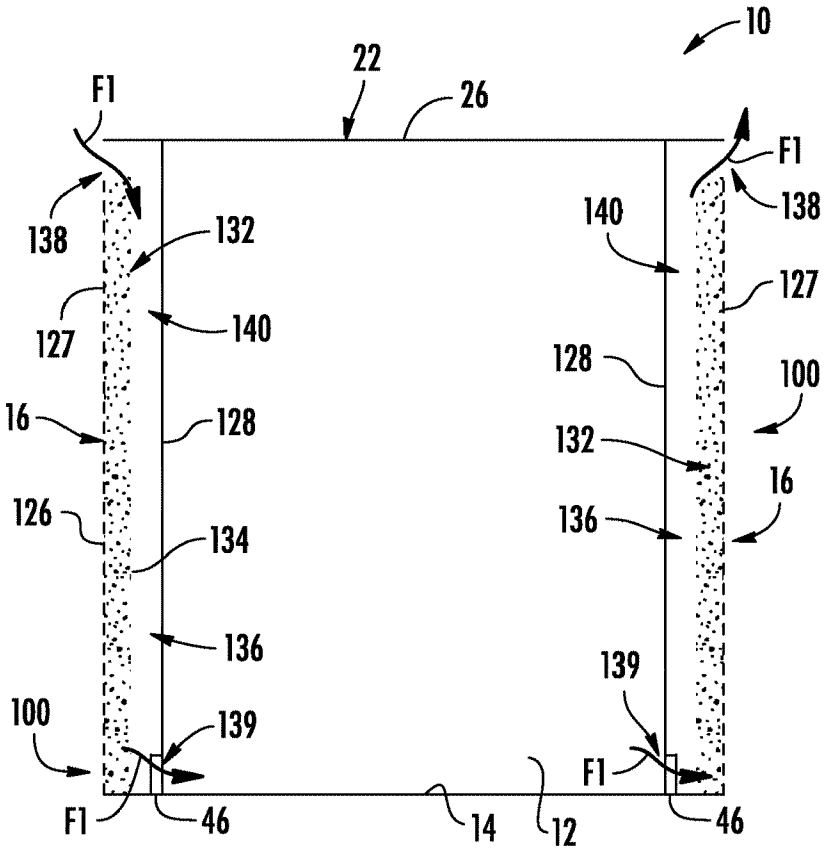
FIG. 5 schematically illustrates a side view of the elevator cab of FIG. 1 showing an embodiment of a double walled panel assembly.
Figure 7:
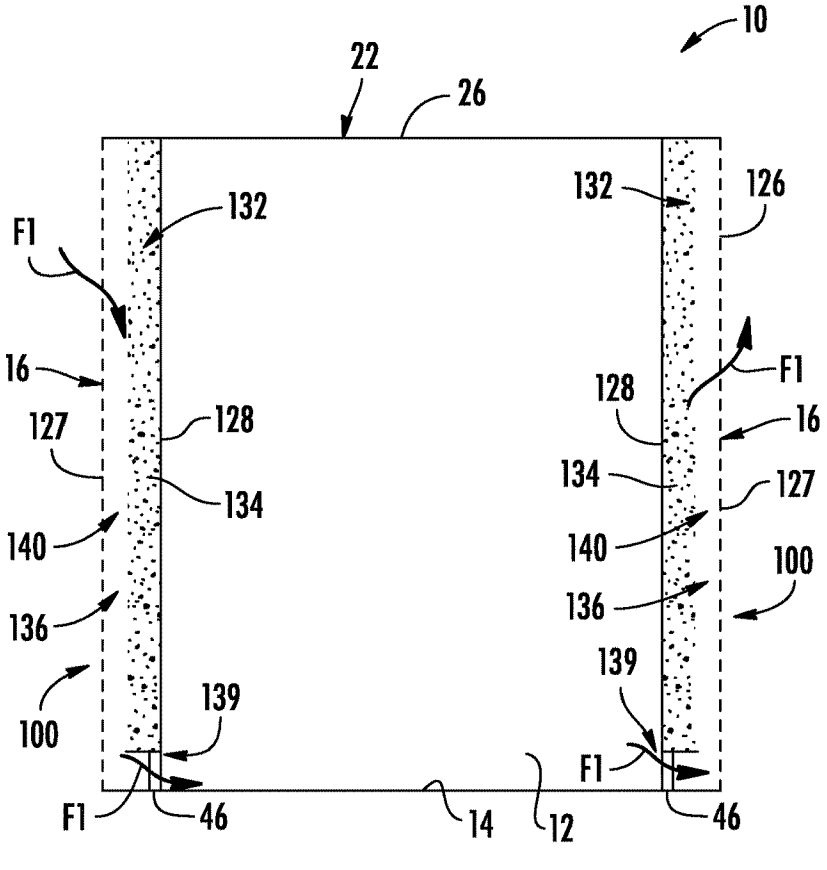
FIG. 7 schematically illustrates a side view of the elevator cab of FIG. 1 showing yet another embodiment of a double walled panel assembly.

FIGS. 5-7 illustrate an embodiment having a double walled panel assembly 100 for use in at least one of the sidewalls 16, the back wall 18, or the front wall 20. Like numbers will be used between similar components in the panel assembly 25 and the panel assembly 100 but with the addition of a leading 1. Although the illustrated embodiment identifies the sidewalls 16, the panel assembly 100 could be used in any combination of the sidewalls 16, the back wall 18, or the front wall 20. Additionally, the panel assembly 25 could be used with the panel assembly 100.

As shown in FIG. 5, the sidewalls 16 include an outer panel 126 spaced from a first inner panel 128 to form an internal cavity 132. In the illustrated embodiment, the outer panel 126 includes perforations 127 and the first inner panel 128 is not perforated. Additionally, the first inner panel 128 is generally parallel to the outer panel 126. The internal cavity 132 includes a foam panel 134 located in abutting contact with the outer panel 126 and an air gap 136 defined between the foam panel and the first inner panel 128.

In the illustrated embodiment, the air gap 136 also at least partially defines a ventilation passage 140. The ventilation passage 140 extends between exterior openings 138 in the outer panel 126 adjacent the ceiling 22 and interior openings 139 adjacent the first inner panel 128 and the floor 14. Alternatively, as shown in FIG. 6, the foam panel 134 could be located adjacent the first inner panel 128 such that the air gap 136 and the ventilation passage 140 are at least partially defined by the outer panel 126 and the foam panel 134 instead of the foam panel 134 and the first inner panel 128.

Although the exterior openings 138 are located adjacent the ceiling 22 and the interior openings 139 are located adjacent to the floor 14, the exterior openings 138 could be spaced from the ceiling 22 as long as the exterior openings 138 are closer to the ceiling 22 than the interior openings 139. Similarly, the interior opening 139 could be spaced from the floor 14, but could be spaced from the floor 14 as long as the interior opening 139 are below the exterior openings 138.

Alternatively, as shown in FIG. 7, the exterior openings 138 could be eliminated by moving the foam panel 134 into abutting contact with the first inner panel 128 to create the ventilation passage 140 between the outer panel 126 and the foam panel 134. Therefore, fluid is able to exit or enter the ventilation passages 140 through any one of the perforations 127 in the outer panels 126 and not an exterior opening 138.

Fans 46 could be located adjacent the interior openings to draw or push the fluid F1 through the ventilation passages 140 and/or the passenger compartment 12. When the foam panel 134 is located in abutting contact with the outer panel 126, as show in FIG. 5, a greater portion of the fluid F1 will be drawn through or pushed out the exterior openings 138 in communication with the ventilation passages 140. However, when the foam panel 134 is located in abutting contact with the first inner panel 128, the fluid F1 will be drawn through or pushed out a combination of the exterior openings 138 and the perforations 127, as shown in FIG. 6, or just the perforations 127, as shown in FIG. 7.

Figure 8:
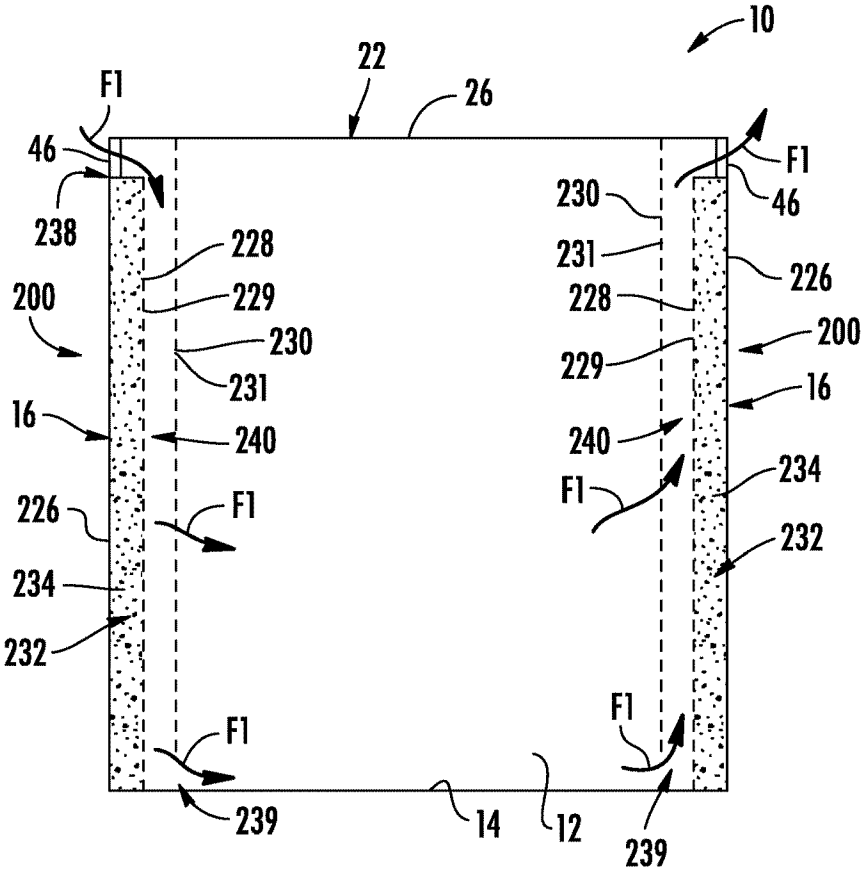
FIG. 8 schematically illustrates a side view of the elevator cab of FIG. 1 showing an embodiment of a triple walled panel assembly.
Figure 10:
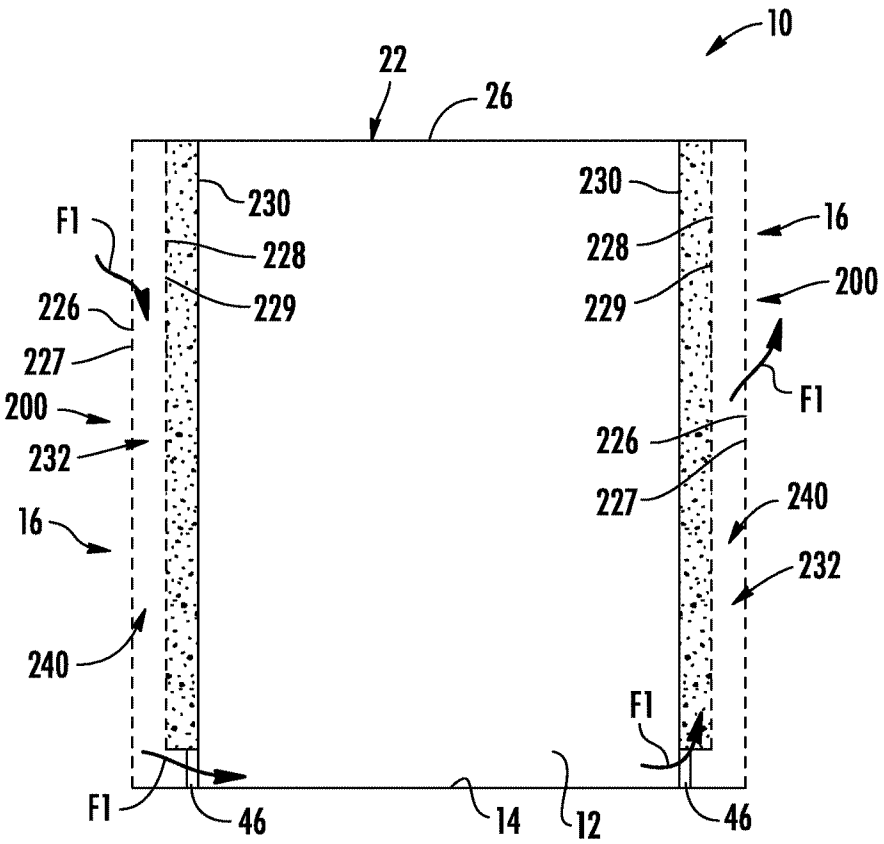
FIG. 10 schematically illustrates a side view of the elevator cab of FIG. 1 showing yet another embodiment of a triple walled panel assembly.
Figure 9:
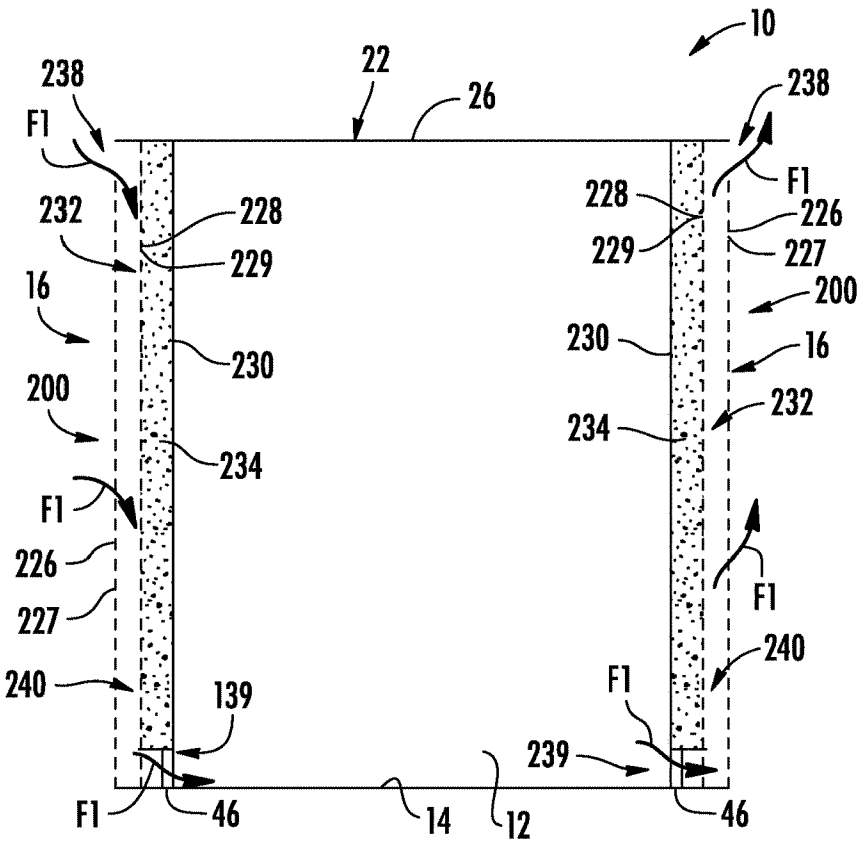
FIG. 9 schematically illustrates a side view of the elevator cab of FIG. 1 showing another embodiment of a triple walled panel assembly.

FIGS. 8-10 illustrate an embodiment having a triple walled panel assembly 200 for use in at least one of the sidewalls 16, the back wall 18, or the front wall 20. Like numbers will be used between similar components in the panel assemblies 25, 100 and the panel assembly 200 but with the addition of a leading 2. Although the illustrated embodiment identifies the sidewalls 16, the panel assembly 200 could be used in any combination of the sidewalls 16, the back wall 18, or the front wall 20. Additionally, the panel assemblies 25, 100 could be used with the panel assembly 200.

As shown in FIG. 8, the sidewalls 16 include an outer panel 226 spaced from a first inner panel 228 and a second inner panel 230. In the illustrated embodiment, the first inner panel 228 includes perforations 229 and the second inner panel 230 includes perforations 231. The outer panel 226, the first inner panel 228, and the second inner panel 230 are also generally parallel to each other. An internal cavity 232 is located between the outer panel 226 and the first inner panel 228. The internal cavity 232 includes a foam panel 234 located in abutting contact with the outer panel 226 and the first inner panel 228 such that there isn't an air gap between the foam panel 234 and either of the outer panel 226 and the first inner panel 228. However, a spacing between the outer panel 226 and the first inner panel 228 could be enlarged to create an air gap adjacent the foam panel 234 or the amount of foam based material being used in the foam panel 234 could be reduced to crate the air gap.

Furthermore, the first inner panel 228 and the second inner panel 230 at least partially defines a ventilation passage 240. The ventilation passage 240 extends between exterior openings 238 in the outer panel 226 adjacent the ceiling 26 and interior openings 239 adjacent the second inner panel 230 and the floor 14. The ventilation passage 140 also extends past ends of the outer panel 226, the foam panel 234, the first inner panel 228, and the second inner panel 230.

Alternatively, as shown in FIG. 9, the foam panel 234 could be located in abutting contact with the first and second inner panels 228, 230. In this embodiment, the ventilation passage 240 would extend from the exterior openings 238 between the outer panel 226 and the first inner panel 228 and the interior openings 239. Additionally, the outer panel 226 could include perforations 227 while the second inner panel 230 would not include perforations. This would maintain perforated panels adjacent the ventilation passage 240 in the panel assembly 200.

Although the exterior openings 238 are located adjacent the ceiling 22 and the interior openings 239 are located adjacent to the floor 14, the exterior openings 238 could be spaced from the ceiling 22 as long as the exterior openings 238 are closer to the ceiling 22 than the interior openings 239. Similarly, the interior openings 239 do could be spaced from the floor 14 as long as the interior opening 239 are below the exterior openings 238.

Alternatively, as shown in FIG. 10, the exterior openings 238 could be eliminated when the foam panel 234 into abutting contact with the first and second inner panels 228, 230 such that the ventilation passage 240 is located between the outer panel 226 and the first inner panel 228. Therefore, fluid is able to exit or enter the ventilation passages 240 through any one of the perforations 227 in the outer panel 226.

Fans 46 could be located adjacent the interior openings to draw or push the fluid F1 through the ventilation passages 240 and the passenger compartment 12. When the foam panel 234 is located in abutting contact with the outer panel 226 as show in FIG. 8, a greater portion of the fluid F1 will be drawn through or pushed out the exterior openings 238 in communication with the ventilation passages 240. However, when the foam panel 234 is located adjacent the second inner panel 228, the fluid F1 will be drawn through or pushed out a combination of the exterior openings 238 and the perforations 227 as shown in FIG. 9 or just the perforations 227 as shown in FIG. 10.

Figure 11:
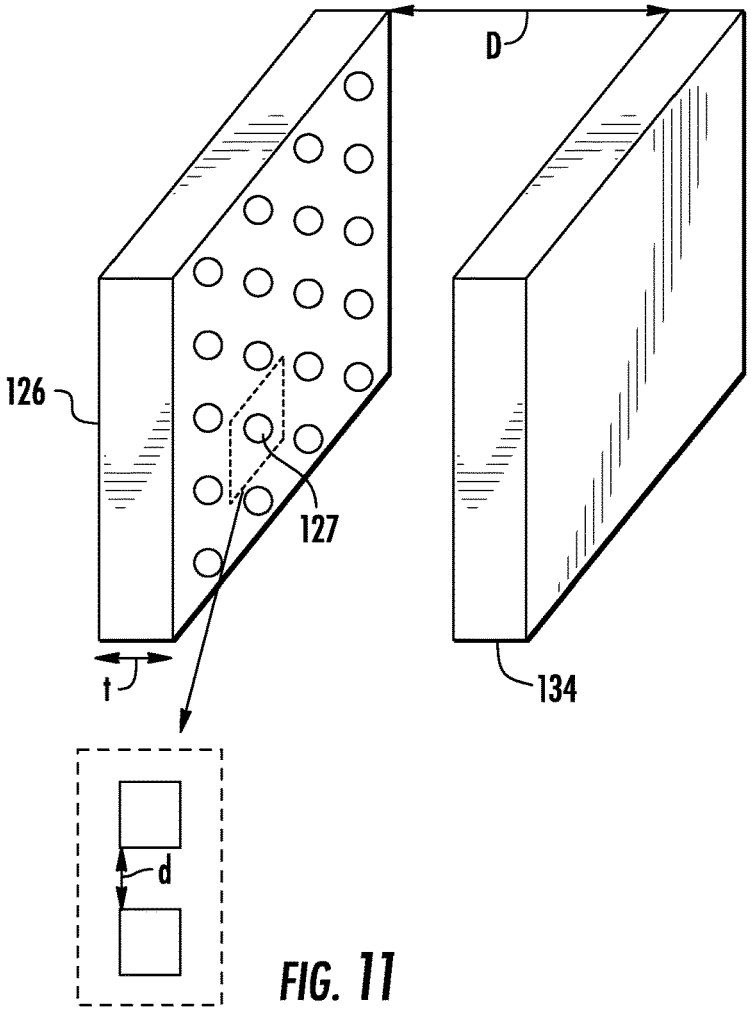
FIG. 11 is an enlarged view of a panel adjacent to a foam panel.

In addition to the main structural configuration of the panel assemblies 25, 100, and 200 discussed above, several variables within the panel assemblies can be modified to target noise reduction at specific frequencies, such a high frequencies or low frequencies. One variable that can be modified to further reduce noise is a thickness of any one of the panels in the panel assemblies 25, 100, or 200. In particular, the panels can range in thickness (t—FIG. 11) from 0.30 mm to 10 mm The panels can be made from at least one of metal, wood, paper, or composite materials. Additionally, the heights of the end walls 42 and 44, which function as drop ceilings, can provide a further reduction in noise when used in combination with the panel assembly 25.

Another modification to the panels in the panel assemblies 25, 100, 200, is a variation in diameter of the perforations in the panels. For example, the perforations are generally less than 25 mm in diameter (d—FIG. 11) and generally not smaller than 0.30 mm in diameter with smaller diameter perforations providing a greater reduction in low frequency noise. Additionally, a perforation ratio of the sum of the cross-sectional areas of all the perforations in a panel versus the entire area of the panel usually is less than 50% and more than 0.01%. The absorption capability at the desired frequency range (normally above 100 Hz) can be designed by adjusting the parameters of perforation ratio, panel thickness, perforation size, air-gap thickness and foam thickness & material. Furthermore, the diameter (d) of the perforations is not required to be constant between all of the perforations in a single panel. Additionally, the perforation shapes can be any shapes including round, square, slotted, hexagonal or others. The distributions of the perforation opening can be either evenly or unevenly.

Additionally, the type and position of the foam panels 34, 134, 234 can further vary the noise reduction of the panel assemblies 25, 100, 200. As shown in the various panel assemblies 25, 100, 200, the foam panel 34, 134, 124, respectively, can be located in various positions. Further example modifications can include a width of an air gap (D—FIG. 11) between the foam panel 34, 134, 234 and an adjacent panel. Additionally, the density, fluid resistivity, porosity, and elastic performance can impact the level of noise reduction in the panel assemblies 25, 100, 200.

Figure 12:
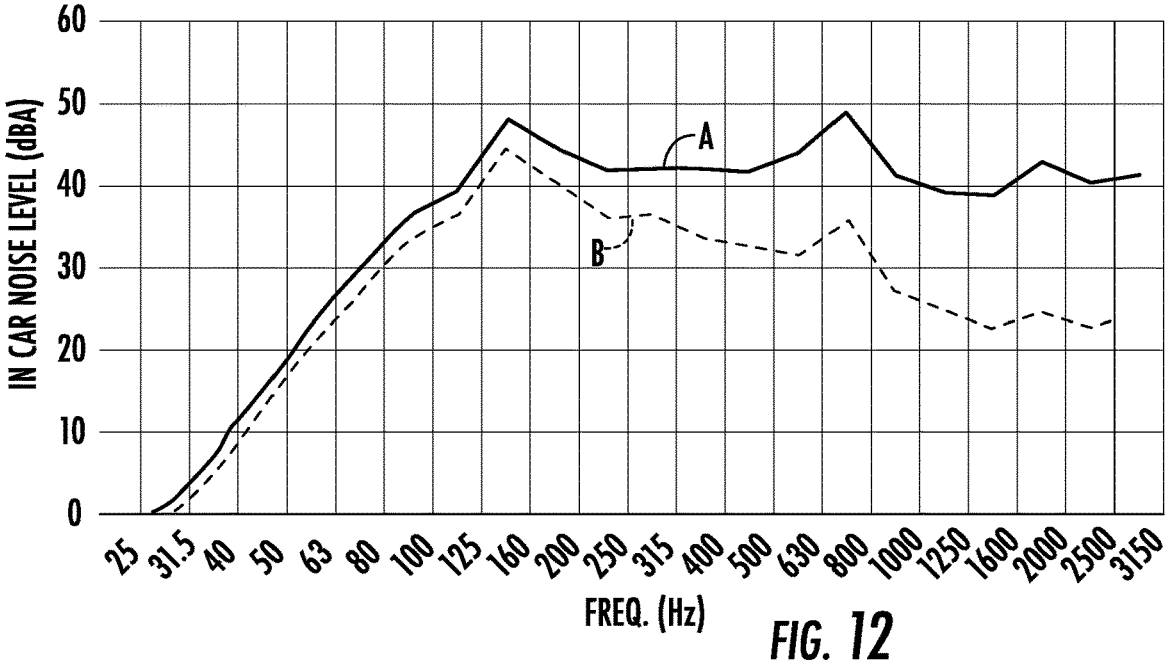
FIG. 12 is a graph of predicted noise reduction spectra comparing noise levels for a tradition panel assembly in an elevator cab and noise reduction for an elevator cab incorporating aspects of this disclosure.

An example of noise reduction incorporating the considerations identified above between a traditional panel assembly and one incorporating aspects of this disclosure is shown in FIG. 12. Solid line A represents the traditional panel system and dashed line B represents a panel system incorporation aspects of the invention and the reduction in noise level (dBA) that results over a range of frequencies.

It should be understood that terms such as "generally," "substantially," and "about" are not intended to be boundaryless terms, and should be interpreted consistent with the way one skilled in the art would interpret those terms. Further, directional terms such as "vertical," "horizontal," "above," and "below" are used consistent with their plain and ordinary meanings with reference to the normal operational attitude of an elevator cab and should not otherwise be considered limiting.

Although the different embodiments have the specific components shown in the illustrations, embodiments of this disclosure are not limited to those particular combinations. It is possible to use some of the components or features from one of the embodiments in combination with features or components from another one of the embodiments. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A panel assembly for an elevator cab comprising:

an outer panel defining an exterior surface and a ceiling of the elevator cab;

a first inner panel spaced from the outer panel and at least partially defining a first cavity with the outer panel;

a second inner panel at least partially defining a ventilation passage with the first inner panel;

a foam panel located adjacent one of the outer panel and the first inner panel; and a first passage opening associated with the first panel and in fluid communication with the ventilation passage.

2. The panel assembly of claim 1, wherein at least one of the first inner panel and the second inner panel is perforated.

3. The panel assembly of claim 2, where the at least one of the first inner panel and the second inner panel that is perforated includes a perforation ratio of less than 50% and more than 0.01%.

4. The panel assembly of claim 1, wherein the first inner panel and the second inner panel are both perforated panels.

5. The panel assembly of claim 1, further comprising a first pair of end walls at least partially define the first cavity with the outer panel.

6. The panel assembly of claim 5, further comprising a second pair of end walls at least partially defining the ventilation passage with the first pair of end walls.

7. The panel assembly of claim 1, further comprising a second passage opening in fluid communication with the passage opening and a fan located adjacent one of the first passage opening and the second passage opening.

8. The panel assembly of claim 1, wherein both the first inner panel and the second inner panel is perforated.

9. The panel assembly of claim 8, where both the first inner panel and the second inner panel are perforated includes a perforation ratio of less than 50% and more than 0.01%.

10. The panel assembly of claim 8, wherein the foam panel located adjacent the second inner panel.

11. The panel assembly of claim 10, further comprising a first pair of end walls at least partially define the first cavity with the outer panel.

12. The panel assembly of claim 11, further comprising a second pair of end walls at least partially defining the ventilation passage with the first pair of end walls.

* * * * *